US005769314A

United States Patent [19]

Drees et al.

[11] Patent Number: 5,769,314

[45] Date of Patent: Jun. 23, 1998

[54] VARIABLE AIR VOLUME HVAC SYSTEM CONTROLLER AND METHOD

[75] Inventors: Kirk H. Drees, Cedarburg; M. Nebil Ben-Aissa, Franklin, both of Wis.

[73] Assignee: Johnson Service Company, Milwaukee, Wis.

[21] Appl. No.: 618,745

[22] Filed: Mar. 20, 1996

[51] Int. Cl.[6] ..... F24F 7/00; F25B 7/00

[52] U.S. Cl. ..... 236/49.3; 62/175; 165/217

[58] Field of Search ..... 236/49.3; 62/229, 62/175; 454/239; 165/217

[56] References Cited

U.S. PATENT DOCUMENTS 5,257,508 11/1993 Powell et al. ..... 62/229
5,344,069 9/1994 Narikiyo ..... 236/49.3

*Primary Examiner*—William E. Wayner
*Attorney, Agent, or Firm*—Harness, Dickey & Pierce, P.L.C.

[57] ABSTRACT

A variable air volume heating, ventilation and air conditioning (HVAC) system controller with adaptive control architecture adjusts control parameters to provide for increased direct expansion coil air flow and reduced compressor cycling. The supply air temperature set point is adjusted as a function of the return air temperature and compressor cycling is time limited.

19 Claims, 4 Drawing Sheets

| CYCLES / Era(k) | LOW | MED. | HIGH |
|---|---|---|---|
| NB | M | L | VL |
| N | H | M | L |
| Z | VH | H | M |
| P | H | M | L |
| PB | M | L | VL |

| Esp,c(k) / Era(k) | NB | N | Z | P | PB |
|---|---|---|---|---|---|
| NB | NB | NB | N | N | N |
| N | NB | N | Z | Z | Z |
| Z | N | H | M | H | M |
| P | Z | Z | Z | P | PB |
| PB | Z | Z | P | PB | PB |

RULE TABLE

VARIABLE AIR VOLUME HVAC SYSTEM CONTROLLER AND METHOD

FIELD OF THE INVENTION

The present invention relates generally to heating, ventilation and air conditioning (HVAC) systems and more particularly, to a variable air volume HVAC system controller.

BACKGROUND OF THE INVENTION

Variable air volume (VAV) air conditioning units with direct expansion (DX) cooling coils are commonly used in small to medium commercial HVAC applications. Such systems typically provide a source of conditioned air (generally cooled but potentially heated to a supply air temperature, $T_{sa}$) via a supply air duct system to a plurality of VAV distribution devices for supplying the conditioned air to building zones. The VAV devices regulate the amount of conditioned air introduced into each of the respective zones so that a desired set point temperature is maintained in the respective zone. Therefore, the zone flow rate requirement is a function of the energy gains through the envelope, internal heat generation, and the supply air temperature, $T_{sa}$. Air from the zones is collected into a return air duct system, and typically a portion of the return is mixed with the outside air to provide the source of supply air. The remainder of the return air is discharged from the system.

Mechanical cooling is often required to condition the supply air. When it is required, a (DX) evaporator coil is used in the air supply system to remove heat and possibly moisture from the supply air. The capacity of the DX coil to remove heat is related to the number of operating compressors, or the status of unloaders, and the air flow rate through the DX coil. Capacity is added or subtracted in relatively large discrete increments, or stages, and it is not possible to finely adjust the capacity. Therefore, it is difficult through use of a controlling device to control capacity as a smooth function of a controller output.

In the typical system, the controlling device is implemented with proportional (P) or proportional-integral (PI) feedback control loops, and the controlled variable is set point $T_{sa}$. The controller manipulates the number of operating compressors and/or unloaders in response to a departure of $T_{sa}$ from a desired $T_{sa}$. The time constant of the DX coil is relatively short (typically less than 1–3 minutes) and the minimum change in relative capacity per compressor and/or unloader stage is large (typically 25% of total capacity), large oscillations in the supply air temperature and excessive compressor cycle rates are common. High cycle rates, however, are highly undesirable because compressor life is inversely related to compressor cycle rate.

Ideally, one desires to control the supply air temperature within a close tolerance to a fixed set point. Without the penalty associated with rapid cycling of compressors it would be possible to accomplish this goal. However, since the cycle times required to closely control $T_{sa}$ would be very short, and considerably shorter than the DX coil time constant, the life of the compressors would be very short. Taking an approach of minimizing cycle rate leads to large changes in $T_{sa}$ as the VAV devices regulate zone flows and ultimately the airflow rate through the evaporator coil. The large changes in $T_{sa}$ adversely impact the ability of the zone VAV controllers to maintain their set points resulting in potential excessive mechanical wear on the VAV actuators, linkages and damper.

Therefore, there is a need for a variable air volume HVAC system controller which minimizes compressor cycling while providing acceptable zone temperature control, accuracy and stability.

DETAILED DESCRIPTION OF THE PREFERRED EMBODIMENTS

The present invention is described in terms of several preferred implementations as part of a variable air volume HVAC system. The invention is implemented as a controller which provides for minimized compressor cycle rates to enhance compressor life and stable supply air characteristics.

Figure 1:
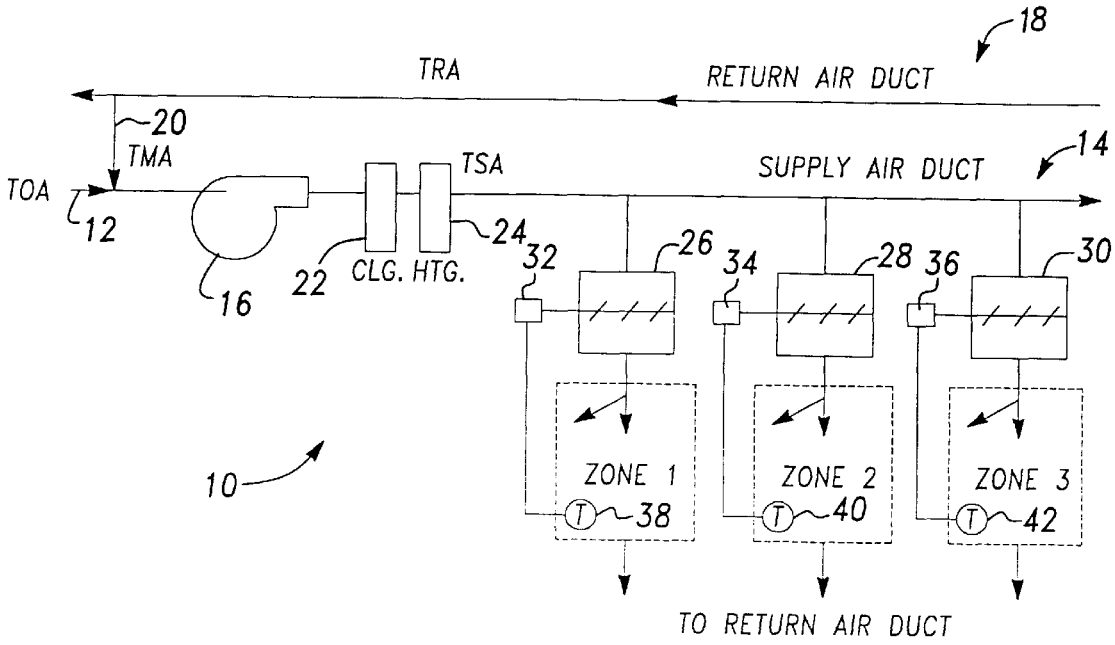
FIG. 1 is block diagram illustrating a typical variable air volume HVAC system.

Referring then to FIG. 1, a typical VAV type HVAC system 10 is shown servicing zones 1, 2 and 3; it being understood that the present invention is applicable to any number of zones. Outside air is drawn into the system at inlet 12. The outside air is mixed with a proportional amount of return air from the return air duct system 18 via return duct 20 at the intersection of ducts 12 and 20 thereby providing a mixed supply air source to HVAC system 10. The energy saving and ventilating purposes for using a mixed supply air source are well understood in the art and therefore not discussed further here. The supply air is forced through the supply air duct system 14 in a known manner by blower 16. Supply air duct system further includes DX coil 22 and heating element 24 for selectively cooling or heating the supply air under direction of the HVAC system controller (not shown). The DX coil is suitably connected to a refrigeration circuit including at least one compressor/unloader stage as is also well know in the art.

The supply air is communicated via supply air duct system 14 to a plurality of VAV devices 26–30. VAV devices 26–30, as are well known in the art, generally consist of a damper assembly secured within a housing fitted with suitable actuators for moving the damper for selectively controlling the flow rate of supply air into the zone. VAV devices 26–30 may have a decentralized controller such as 32–36, respectively. Controllers 32–36 receive a signal from air characteristic sensing devices 38–42, typically thermostats, located within zones 1–3, respectively. In response to the signal VAV devices 26–30 adjust the flow of supply air into the zone. It should be understood that the VAV controllers may receive signals from a centralized control system or via some other control architecture without departing from the scope of the present invention.

Figure 2:
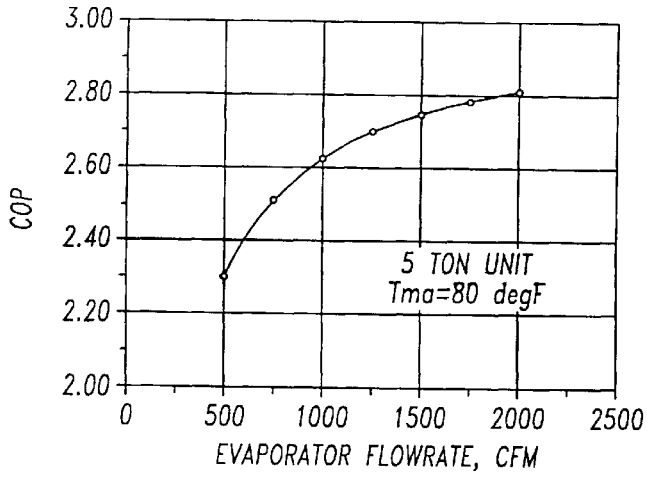
FIG. 2 is a chart illustrating the relationship of COP as a function of air flow rate.

To achieve an acceptable compromise between compressor life and zone temperature control accuracy, the present invention recognizes the desirability to minimize supply air flow rate throttling range to an upper portion of its admissible domain. Doing so contributes to lower energy costs since the equipment COP rises with increasing air flow through the evaporator as shown in FIG. 2. At lower flow rates, the COP drops due to increased entropy production at the evaporator coil resulting in greater compressor lift requirements for a given refrigerant mass flow rate. Higher evaporator flow rates also provide better mixing within the zones which leads to the advantage of improved indoor air quality (IAQ) since temperature gradients and regions of low air velocity (stuffiness) are reduced.

Typical DX air conditioning applications are cost sensitive. Therefore, evaporator flow rate is not measured and there is no temperature feedback from the zones to the compressor controller. As a result it is not possible to directly measure heat gains for use as an input to compressor staging decisions. The temperature drop across the evaporator is not a good indicator of load since it is strongly coupled to the unmeasured/unknown air flow rate. The controller of the present invention recognizes these cost limitations in providing an improved control system without increased equipment cost.

Figure 3:
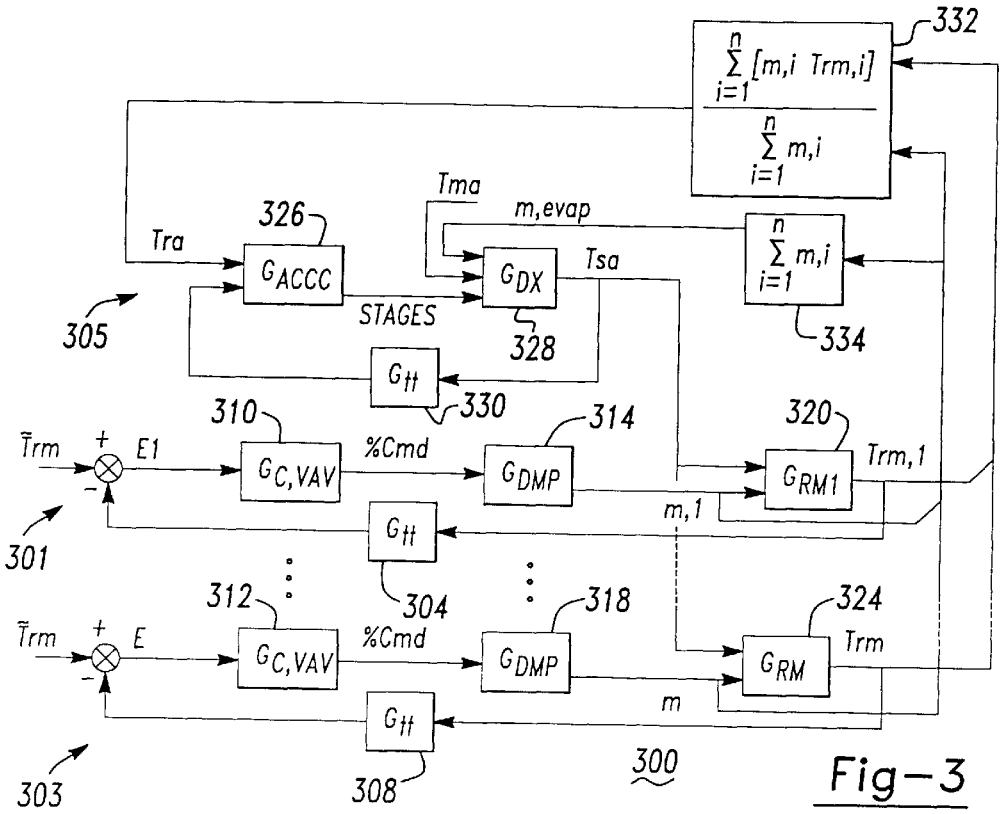
FIG. 3 is system block diagram illustrating a preferred implementation of the HVAC system controller of the present invention.

Referring then to FIG. 3, a block diagram of an HVAC system controller 300 in accordance with a preferred embodiment of the present invention is shown. For each zone 1–3, a corresponding control path 301–303 is provided (note path 302 and its associated components are not shown in FIG. 3). As an input to the nth path is a room temperature set point ($\sim T_{rm,n}$) and a signal corresponding to the sensed room temperature ($T_{rm,n}$) . Dynamics associated with the measuring device are accounted for in blocks 304–308, respectively, for paths 301–303. A VAV controller 310–312 provides a percent command signal in response to a difference between $T_{rm,n}$ and $\sim T_{rm,n}$ which is communicated to the VAV actuator/damper, shown as block 314–318 for effecting the flow rate (m,n) of supply air into the zone. As is known, the zone temperature ($T_{rm,n}$) is a function of the energy gains into the zone, heat generation within the zone, and the supply air temperature, $T_{sa}$, and are represented by blocks 320–324.

Controller 300 further includes a compressor control path 305 for controlling the capacity of DX coil 22. Compressor control path 305 includes control block 326, DX coil block 328, supply air temperature block 330, return air temperature block 332 and flow rate block 334. Control block 326 receives as inputs return air temperature ($T_{ra}$), provided by block 332 which determines a weighted return air temperature based on flow and temperature of the return air from each zone, and the supply air temperature ($T_{sa}$) from block 330 and provides a signal to DX coil block 328 for effecting the capacity of DX coil 22. In the preferred embodiment the signal from block 326 operates to cause compressor and/or unloader stages to be added or subtracted thereby increasing or decreasing the capacity of DX coil 328, respectively. The temperature, then, of the supply air, $T_{sa}$, is effected by the capacity of DX coil 22, which is related to the number of compressor/unloader stages operating, the temperature, $T_{ma}$, of the mixture of outside air and return air, and the flow of the air through DX coil 22.

Figure 4:
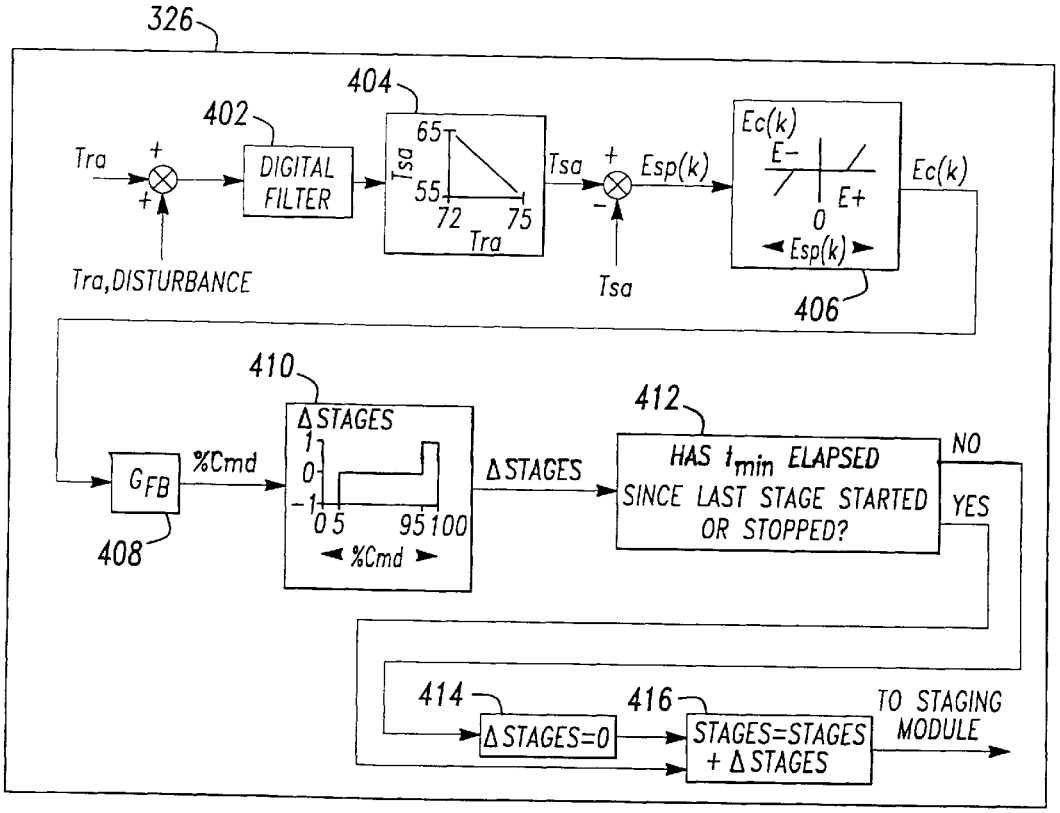
FIG. 4 is a block diagram illustrating a preferred implementation of an adaptive compressor controller of the HVAC system controller of the present invention.

With reference then to FIG. 4, a more detailed representation of control block 326 is provided. Block 402 is a digital filter which is used to smooth undesirable effects of oscillations and noise in the return air temperature ($T_{ra}$) measurement. A large filter time constant is preferred for filter 402 to attenuate these oscillations or disturbances ($T_{ra,dist}$). The digital filter may be of any suitable type such as an exponential or moving average type filter.

At block 404 representing a first control element using open-control proportional control, a supply air set point temperature is determined as a function of the filtered return air temperature. The $T_{sa}$ set point is linearly reset as function of a return air characteristic, such as return air temperature, and to maintain the system flow rate in the upper portion of the admissible region. Whenever VAV devices 26–30 are able to satisfy their zone set points (at the current $T_{sa}$ set point) the $T_{sa}$ set point is maintained near its higher admissible temperature. If the $T_{sa}$ set point temperature is too high for the load, the corresponding rise in return air temperature will reset the $T_{sa}$ set point to a lower value. The $T_{ra}$ reset range, which exemplifies a desired return air characteristic should be selected so that the lower range limit (e.g. 72 in FIG. 4) is equal to the anticipated average zone temperature set point. The high $T_{ra}$ range limit should be approximately 2–3 degrees Fahrenheit (°F.) greater than the lower limit. The difference between the high and low $T_{ra}$ limits should not exceed 3° F. to minimize zone temperature offset. It may also be desirable to bias the $T_{ra}$ limits if the $T_{ra}$ is strongly coupled to ambient conditions (e.g. solar loads on a roof, etc.). In this case the outdoor air temperature $T_{oa}$ or other measure of ambient conditions would be used to bias the $T_{ra}$ limits.

A second control element 405 determines a $T_{sa}$ set point error ($E_{sp}$) by calculating the difference between the current $T_{sa}$ measurement and the reset $T_{sa}$ set point (from block 404).

Block 406, representing a third control element, receives as an input a $T_{sa}$ set point error ($E_{sp}$), and acts to provide a "dead zone" non-linearity which controls the compressor cycle rate. It forces actual $T_{sa}$ set point error ($E_{sp}$) to be zero within a zone of plus/minus E. Outside the dead zone the controller error $E_c$ is preferably a linear function of $E_{sp}$ as shown. This allows VAV devices 26–30 to satisfy small zone load changes via flow regulation without cycling compressor stages. The compressor cycle rate is directly related to the width of the dead zone, and the time averaged $T_{sa}$ error is inversely related to the width of the dead zone. The dead zone width is preferably adjustable (within a preestablished limit) so that the customer can select a tradeoff between cycle rate and $T_{sa}$ accuracy. The dead zone width could be dynamically adjusted in real time as required to achieve a predetermined relationship between cycle rate and $T_{sa}$ accuracy.

Block 404 and block 408 may constitute a third control element. Block 408 is a proportional (P) or proportional/integral (PI) feedback controller. In a preferred implementation only a P controller is contemplated, however, conditions may dictate use of a PI controller. The P controller is preferred as the proportional gain may be combined into Block 406 by adjusting the slope of the reset ramps outside of the dead zone region. When the output of block 408 is near saturation or zero, block 410, as a fourth control element, acts to request the addition or subtraction of additional compressor/unloader stages.

Blocks 412, 414 and 416 further comprise a cycle limit control element which can be added to the fourth control element. To eliminate the possibility of rapid compressor cycling, block 412 requires that a sliding minimum time period ($t_{min}$) elapse before a compressor is started or stopped. When the elapsed time since the last compressor/unloader was started or stopped is less than ($t_{min}$), block 414 sets the change stages command from block 410 to zero. Otherwise the change stages command from block 410 is passed to block 416 where a the number of operating stages is set to the sum of the number of presently operating stages and the change stages command.

In a preferred implementation, control block 326 would also monitor each compressor start command to insure the system responds as expected. On a start command, the temperature differential across DX coil 22 is noted once steady state is approached. Steady state operation may be assumed after a suitable time delay (e.g. 3–4 coil time constants) or measured with a steady state detector. The steady state detector uses a backward finite difference approximation (BFDA) of the time derivative of the difference between $T_{ma}$ and $T_{sa}$, denoted $T_{evap}$. When the BFDA is within a predefined tolerance about zero, steady state operation is assumed. If the steady state value of $T_{evap}$ is less than a predetermined fraction of $T_{evap}$, at design conditions, a function of a return air characteristic and a desired return air characteristic. For instance, a return air temperature error signal $E_{ra}$ may be the stage is assumed to have failed and the next stage in the sequence is immediately issued a start command. The design $T_{evap}$ is an appropriate reference since $T_{evap}$ is inversely related to the evaporator air flow rate.

Figure 5:
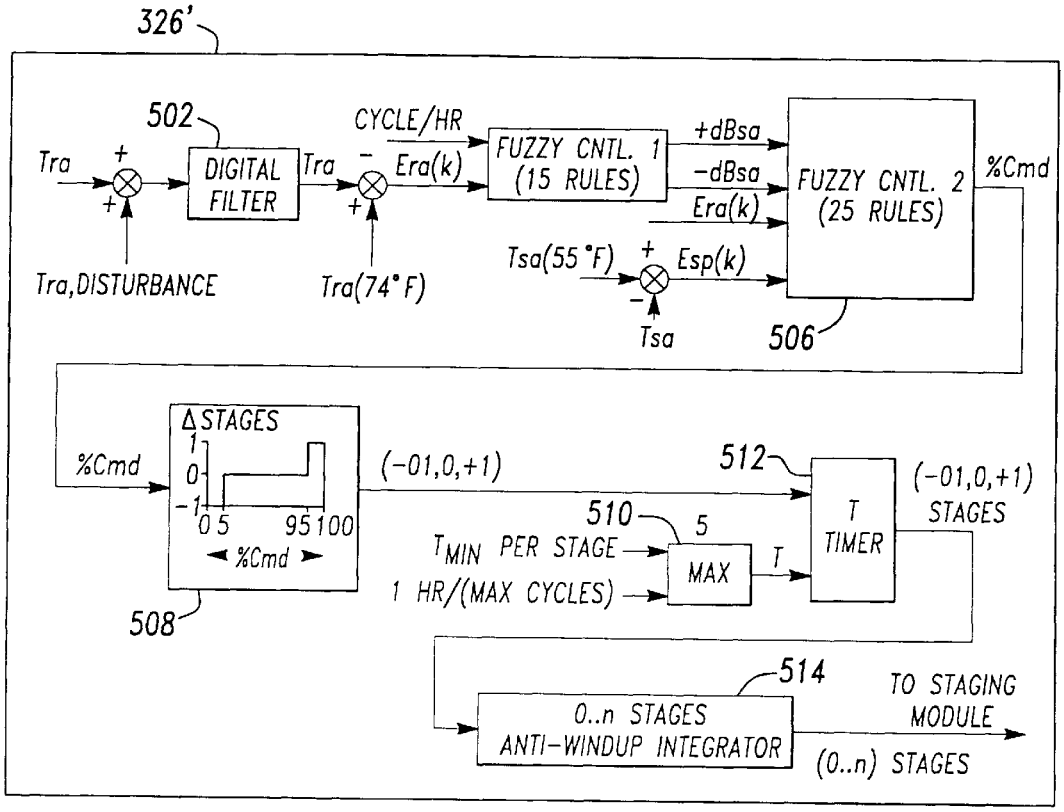
FIG. 5 is a block diagram illustrating an alternate preferred implementation of an adaptive compressor controller of the HVAC system controller of the present invention.

Referring now to FIG. 5, an alternative embodiment of control block 326 (indicated as block 326') is shown. As discussed above, the system is highly nonlinear with large changes in DX coil capacity as a function of operating compressor stages, variable air flow rates, and changing environmental conditions. In combination with imprecise state measurements (dictated by economics of the system) suggests a fuzzy logic controller may benefit the application.

Similar to block 402, block 502 is a digital filter which is used to smooth undesirable effects of oscillations in the return air temperatures ($T_{ra}$). These oscillations or disturbances can be of relatively low frequency and a large filter time constant is preferred for filter 502 which may be of any suitable type such as an exponential or moving average type filter.

Figure 6:
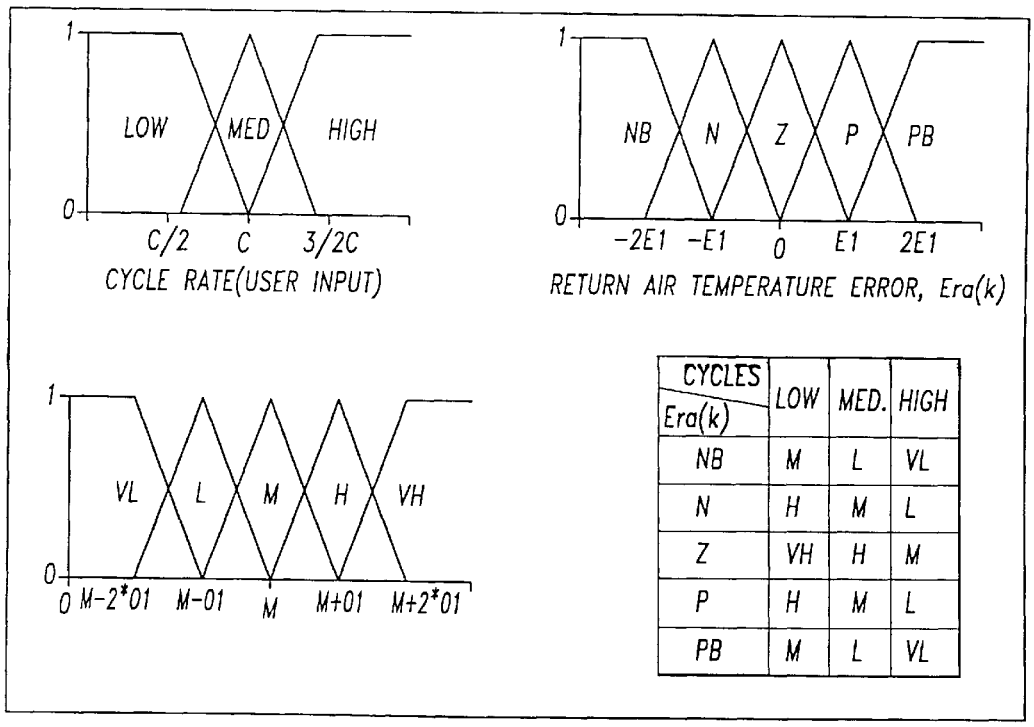
FIG. 6 illustrates the input/output membership functions of a preferred fuzzy implementation of a first control function of the adaptive compressor controller of FIG. 5.

Block 504 is preferably a 15 rule fuzzy controller used to determine the magnitude of the positive and negative membership function widths (+W, −W, respectively) which will be used to size the membership functions of the cascaded fuzzy controller in block 506. Fuzzy controller 504 receives as inputs a return air temperature error signal $E_{ra}$ which is a function of a return air characteristic and a desired return air characteristic. For instance, a return air temperature error signal $E_{ra}$ may be the difference between the filtered return air temperature $T_{ra}$ and the return air temperature set point $T_{ra}$ (in the preferred embodiment 74° F.). A second input to fuzzy controller 504 is an equipment function characteristic, such as the number of cycles per hour which determines the amount of DX cooling/heating effort expected by the system user. The input/output membership functions and rule table are shown in FIG. 6. It should be understood that the values shown in the rule table may be unique for each application and may further be left adjustable by the system user such that they may be adjusted as system dynamics and/or applications change. Constant C, E1, M and O1 are used to denote abscissa values in the membership functions: where the constant C is a preset value used to scale the number of cycles per hour chosen by the user; E1 is a preset constant used to scale the return air temperature error and the preset conditions M (for median) and O1 are used to specify the magnitude of the membership function widths (+W, −W). These constants C, E1, M and O1 allow the control system user to easily tune and scale the membership functions by adjusting the value of one or more constants at a time, and thus determining a set of control parameters.

Figure 7:
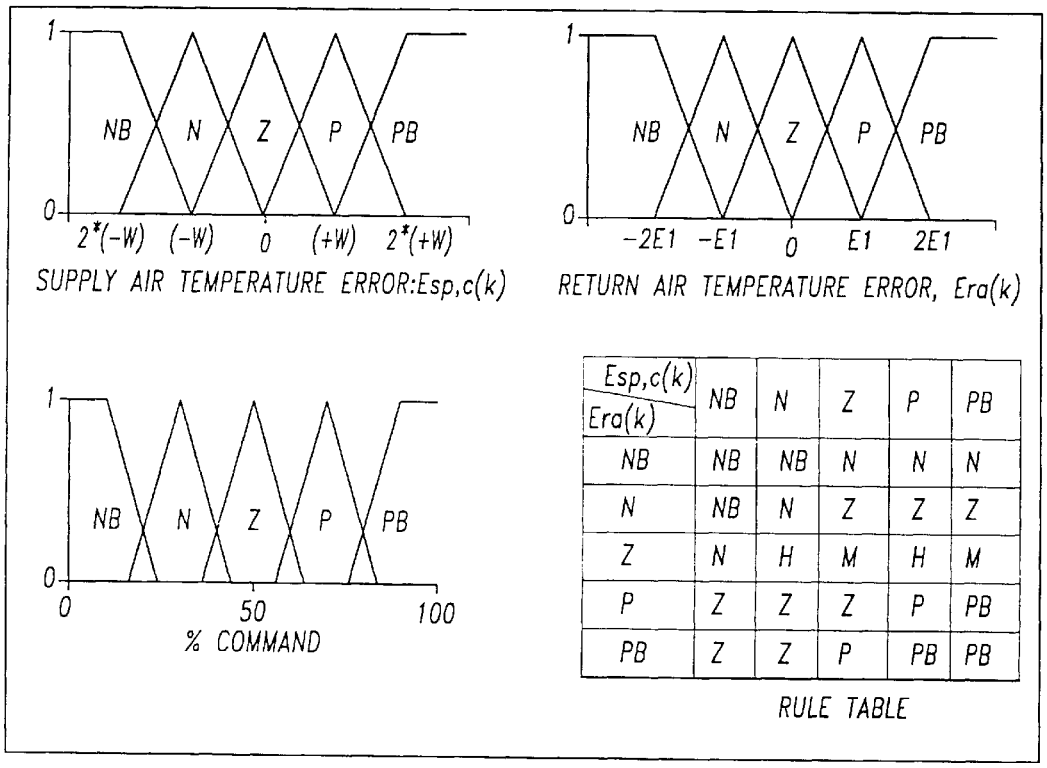
FIG. 7 illustrates the input/output membership functions of a preferred fuzzy implementation of a second control function of the adaptive compressor controller of FIG. 5.

Block 506 is preferably a multiple input single output fuzzy controller which is used to control DX coil 22 capacity based on the return air temperature error $E_{ra}$ and the supply air temperature set point error $E_{sp}$ and the membership function widths or control parameters. The membership functions and rule table for fuzzy controller 506 are shown in FIG. 7. When outputs +W and −W from fuzzy controller 504 change, the fuzzification membership functions are dynamically resized. This dynamic membership function "adjustment" generated by cascading two fuzzy controllers in series allows controller 326' to dynamically adapt to the non-linearities and disturbances generated in the system. Defuzzification of both fuzzy controller 504 and fuzzy controller 506 may be accomplished using the Singleton algorithm, or other defuzzification algorithms as are known in the art.

When the output of fuzzy controller 506 nears saturation, block 508, similar to block 410 provides for requesting an additional compressor/unloader stage. And likewise, when the output of fuzzy controller 506 nears zero, block 508 provides for stopping a compressor/unloader stage. As discussed, fuzzy controller 506 is dynamically adjustable. This allows for relaxing the fuzzification process when the room characteristics are being satisfied, i.e., allow greater variation $T_{sa}$ and reduce the cycles per hour. Similarly, the fuzzification process may be tightened, i.e., the allowable range of $T_{sa}$ reduced and cycles per hour increased, if the room characteristics are not being satisfied.

Blocks 510, 512 and 514 further comprise a cycle limit control element which can be added to the fourth control element. Blocks 510, 512 and 514 insure that excessive cycling of compressors does not occur. These blocks prevent a compressor/unloader stage from being started or stopped within a sliding window of length T since the last time a compressor/unloader was added or subtracted. T is calculated by selecting at block 510 the maximum of two time constants: T1 (1/max. Cycles per hour, as specified by the user) and T2 (minimum allowable time between compressor starts, specified by the DX unit manufacturer). Controller 326' similarly monitors compressor start and stop commands to insure implementation as described above for controller 326.

The controllers of the present invention provide a very cost effective means of balancing compressor cycle rate and the time averaged value of the supply air temperature Tsa to meet a customers preferences. Moreover, the present inventions provide adaptive controllers which are designed to be easily tuned and with minimal microprocessor/memory requirements. These and other advantages of the present invention will be readily appreciated by those skilled in the art, and its broad scope appreciated from the subjoined claims.

We claim:

1. A multiple input single output controller for controlling a characteristic of supply air to an environmental control unit comprising:

a first control element receiving a return air characteristic and a desired return air characteristic, and for determining a supply air set point;

a second control element coupled to receive the supply air set point and for determining a supply air set point error;

a third control element coupled to receive the supply air set point error and for providing a continuous output control signal;

a fourth control element for receiving the continuous output control signal and for providing a staged output signal to said environmental control unit.

2. The controller of claim 1 wherein the first control element comprises a proportional control element.

3. The controller of claim 1 wherein the third control element is operable for setting the supply air set point error to zero under a predetermined criteria.

4. The controller of claim 3 wherein the third control element is operable for setting the supply air set point error to zero under a dynamically established criteria.

5. The controller of claim 4 wherein the control element comprises a dead-zone non-linearity.

6. The controller of claim 1 wherein the third control element comprises a feedback control element.

7. The controller of claim 1 wherein the fourth control element further comprises a cycle limit control element.

8. The controller of claim 1 further comprising a steady state operation detector coupled to the environmental control unit for sensing a steady state condition of the supply air characteristic.

9. The controller of claim 8 wherein the steady state operation detector comprises a backward finite difference approximation (BFDA).

10. A multiple input single output controller for controlling a characteristic of supply air to an environmental control unit comprising:

a first control element receiving an equipment function characteristic, and a return air characteristic and a desired return air characteristic for determining a return air error signal, for determining a set of control parameters;

a second control element coupled to receive the control parameters, the return air error signal and a supply air set point error for providing a continuous control signal output;

a third control element for receiving the continuous output control signal and for providing a staged output signal to said environmental control unit.

11. The controller of claim 10 wherein the second control element comprises a fuzzy control element having a set of input membership functions and wherein the set of control parameters adjusts the characteristics of the input membership functions.

12. The controller of claim 11 wherein the set of control parameters adjusts the width of the input membership functions.

13. The controller of claim 10 wherein the first control element comprises a fuzzy control element.

14. The controller of claim 10 wherein the third control element further comprises a cycle limit control element.

15. The controller of claim 10 further comprising a steady state operation detector coupled to the environmental control unit for sensing a steady state condition of the supply air characteristic.

16. The controller of claim 15 wherein the steady state operation detector comprises a backward finite difference approximation (BFDA).

17. A method of controlling a characteristic of supply air within an environmental control unit comprising:

establishing a set of control parameters in response to a return air characteristic, a desired return air characteristic and an equipment function characteristic;

determining a supply air set point error in response to the control parameters, the return air characteristic and a supply air characteristic set point;

providing a control signal responsive to the supply air set point error; and establishing a staged output signal responsive to the control signal.

18. The method of claim 17 further comprising hard limiting a cycle rate of an element of the environmental unit.

19. The method of claim 18 further comprising detecting a steady state condition of the supply air characteristic.

* * * * *